US007514872B2

(12) United States Patent
Smith et al.

(10) Patent No.: US 7,514,872 B2
(45) Date of Patent: Apr. 7, 2009

(54) REFLECTOR LAMP WITH ENGAGING ELECTRICAL CONTACT

(75) Inventors: Michael P. Smith, Somerville, MA (US); Ebon L. McCullough, New Ipswich, NH (US); Eric W. Keup, Ipswich, MA (US); Ralph Cooper, Londonderry, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 510 days.

(21) Appl. No.: 11/238,942

(22) Filed: Sep. 29, 2005

(65) Prior Publication Data

US 2007/0069652 A1 Mar. 29, 2007

Related U.S. Application Data

(60) Provisional application No. 60/715,193, filed on Sep. 8, 2005.

(51) Int. Cl.
*H01J 17/18* (2006.01)

(52) U.S. Cl. ..... 313/623; 313/634; 313/318.01

(58) Field of Classification Search ..... 313/318.1, 313/318.01, 318.09, 623, 624, 625, 626; 439/615, 620

See application file for complete search history.

(56) References Cited

U.S. PATENT DOCUMENTS 4,920,463 A * 4/1990 Montet ..... 362/519
5,057,735 A * 10/1991 Zalar et al. ..... 313/318.11
5,252,885 A * 10/1993 Muzeroll et al. ..... 313/25
5,381,070 A * 1/1995 Tuttle et al. ..... 313/318.01
5,521,460 A * 5/1996 Zhu ..... 313/318.09
5,550,422 A * 8/1996 Sulcs et al. ..... 313/25
6,017,235 A * 1/2000 Sawada et al. ..... 439/336
6,078,128 A * 6/2000 Gagnon et al. ..... 313/113
6,116,754 A * 9/2000 Ocsovai et al. ..... 362/260
6,239,540 B1 * 5/2001 Wittmann ..... 313/318.09
2005/0213332 A1 * 9/2005 Kendrick et al. ..... 362/296

* cited by examiner

*Primary Examiner*—Karabi Guharay
*Assistant Examiner*—Aaron Williams
(74) *Attorney, Agent, or Firm*—William E. Meyer

(57) ABSTRACT

A lamp (50) has a lamp envelope (10) having a body (12) with a bottom (14) having a lead-in accepting channel (18); a seat (22) formed with the bottom (14) adjacent one of the lead-in accepting channels; a light source capsule (51) having two electrical lead-ins (52, 54) extending therefrom and through the lead-in accepting channel (18; and an electrical contact (24) having a first depending leg (26), an intermediate transverse portion (28) including a seat engager (30) adapted to cooperate with the seat (22), and a projecting leg (32) extending away from the intermediate transverse portion (28) and along a side (34) of the bottom (16), the first depending leg (26) being in mechanical and electrical contact with one of the lead-ins (54).

8 Claims, 4 Drawing Sheets

Fig. 3
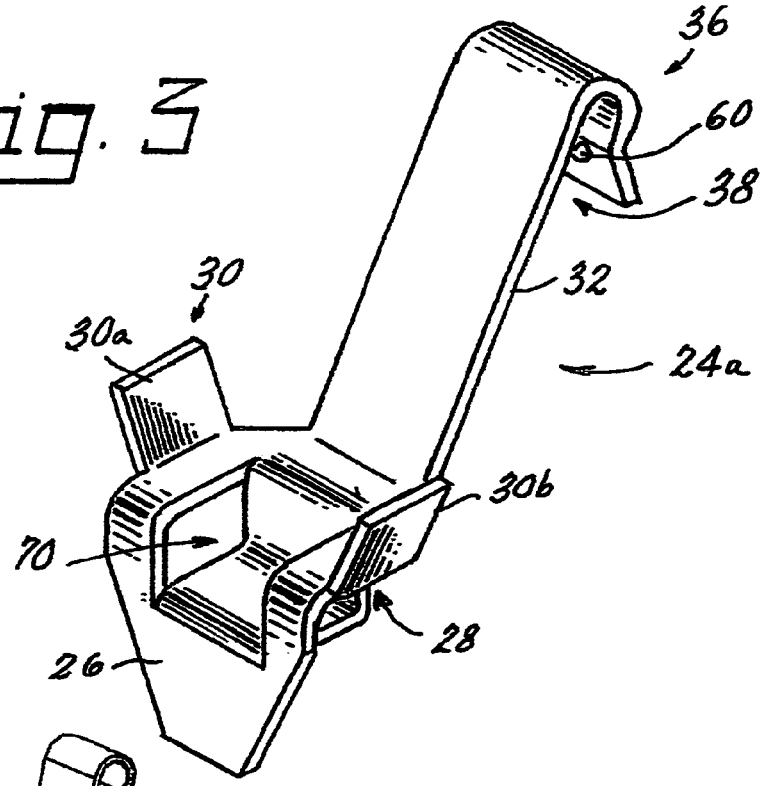
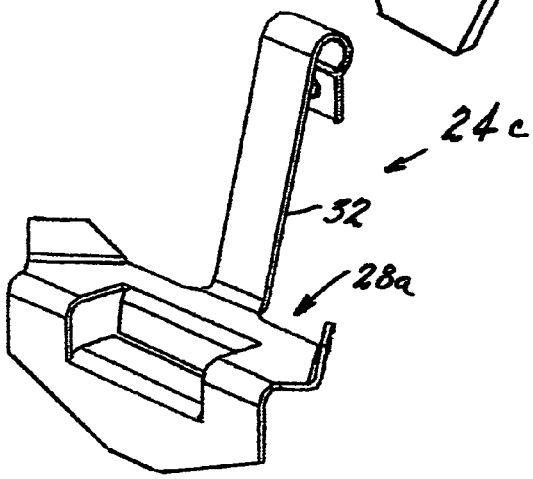
Fig. 5
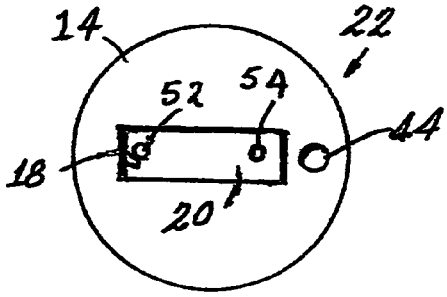
Fig. 6

REFLECTOR LAMP WITH ENGAGING ELECTRICAL CONTACT

CROSS-REFERENCE TO RELATED APPLICATION

This application claims priority from Provisional Patent Application Ser. No.: 60/715,193, filed Sep. 8, 2005.

TECHNICAL FIELD

This invention relates generally to electric lamps and more particularly reflector lamps. Still more particularly, it relates to electrical contacts therefor.

BACKGROUND ART

Reflector lamps, in sizes such as PAR 20 and Par 30, have been employed for many years as floodlights and spot lights. The lamps utilize a light source such as an incandescent filament, a halogen capsule or arc discharge tube. When the latter is used the arc tube is often enclosed in a transparent shield. The lamp otherwise includes a body containing the light source and a base for connection to a power supply. The most common base employed is the standard Edison-type screw base. One of the lamp lead-in wires is connected to the screw portion and the other lead-in wire is connected to the center contact (the eyelet) that is electrically insulated from the screw portion. In previous lamps employing a light source capsule, the light source capsule was cemented into the reflector body using a manual jig to achieve proper location. The capsule was inserted into the jig and a retaining disk was inserted over the press seal of the capsule to hold the capsule in position until the cement cured. This is a manual operation and is very labor intensive. To electrically couple the capsule to the base two wires were utilized, one wire being welded to each capsule lead-in wire. One of the wires is fed through an aperture in the eyelet of the base and fixed thereto, usually by soldering, and the second wire, serving as a grounding wire, is connected to the screw portion of the base. These manual operations are tedious and expensive.

DISCLOSURE OF INVENTION

It is, therefore, an object of the invention to obviate the disadvantages of the prior art.

It is another object of the invention to enhance the manufacture of lamps.

These objects are accomplished, in one aspect of the invention, by a lamp envelope comprising a body having a bottom with a channel; a seat formed with said bottom adjacent to said channel; and an electrical contact having a first depending leg, an intermediate transverse portion including a seat engager adapted to cooperate with said seat, and a projecting leg extending away from said intermediate transverse portion and along a side of said bottom.

The objects are further accomplished by a lamp comprising: a lamp envelope having a body with a bottom having a channels a seat formed with said bottom adjacent said channel; a light source capsule having a base with two electrical lead-ins extending therefrom, said base being received in said channel; and an electrical contact having a first depending leg, an intermediate transverse portion including a seat engager adapted to cooperate with said seat, and a projecting leg extending away from said intermediate transverse portion and along a side of said bottom, said first depending leg being in mechanical and electrical contact with one of said lead-ins.

This electrical contact provides both electrical and mechanical support for the light source capsule and is automatable, eliminating much hand labor. The contact is rugged and is produced from flat stock and bent with simple machine tooling.

BRIEF DESCRIPTION OF THE DRAWINGS

FIG. 3 is a similar view of an alternate embodiment;

FIG. 5 is a view similar to FIG. 3 and illustrating the adaptability of invention to various sizes of lamps; and FIG. 6 is a diagrammatic end view of a lamp envelope bottom in another aspect of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
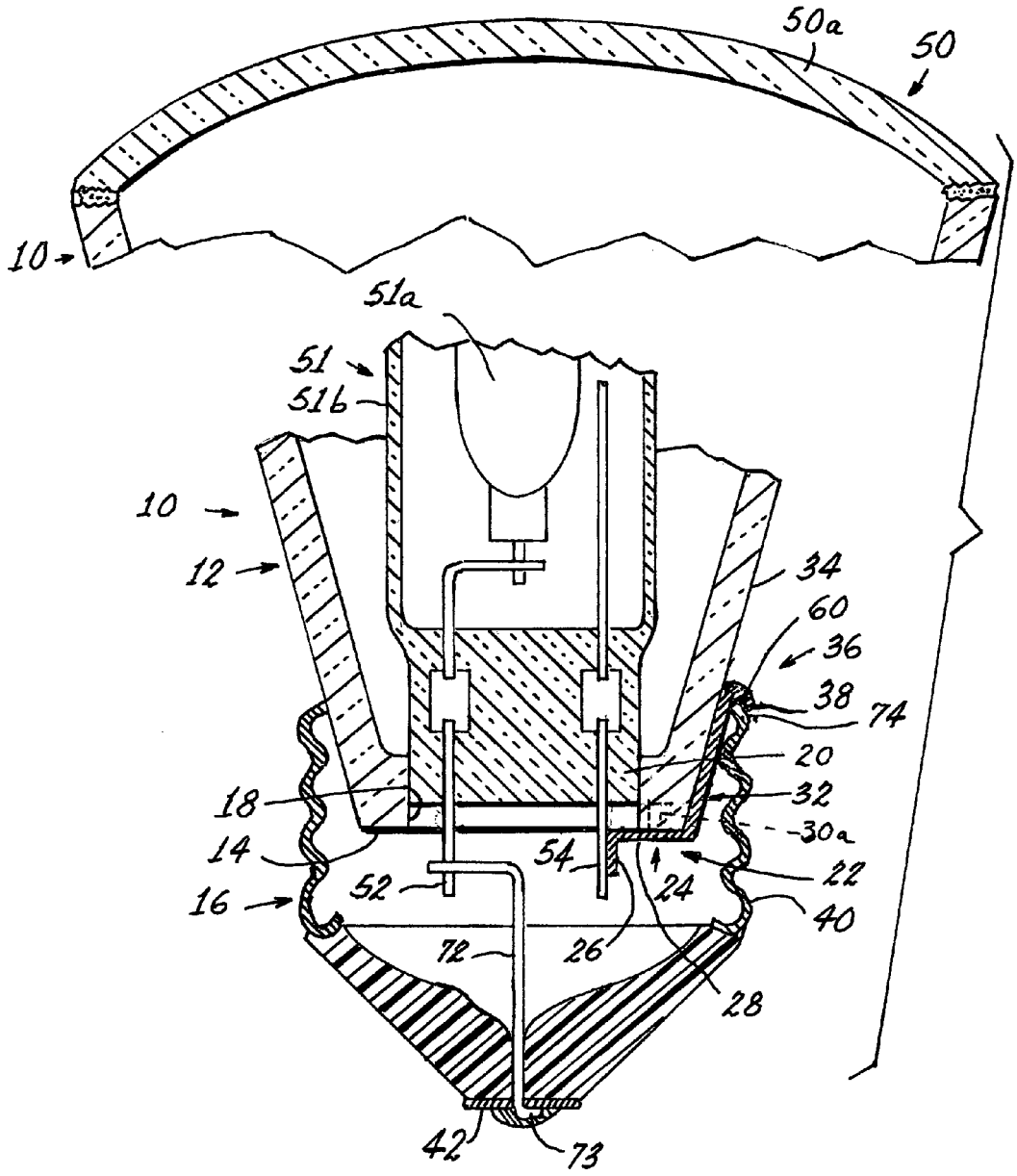
FIG. 1 is a broken, sectional view of a lamp according to an aspect of the invention.

Referring now to the drawings with greater particularity, there is shown in FIG. 1 a lamp 50 comprising a lamp envelope 10 having a body 12 with a bottom 14 having a lead-in accepting channel 18. A lens or cover 50*a* closes the body 12. A seat 22 is formed with the bottom 14 adjacent the lead-in accepting channel 18. A light source capsule 51 has two electrical lead-ins 52, 54 extending from a rectangular capsule base 20, which fits into the channel 18. The light source capsule 51 can comprise an arc discharge tube 51*a* sealed into a transparent shield 51*b*. Alternatively, the light source can be a filamented lamp, such as a tungsten halogen capsule.

Figure 2:
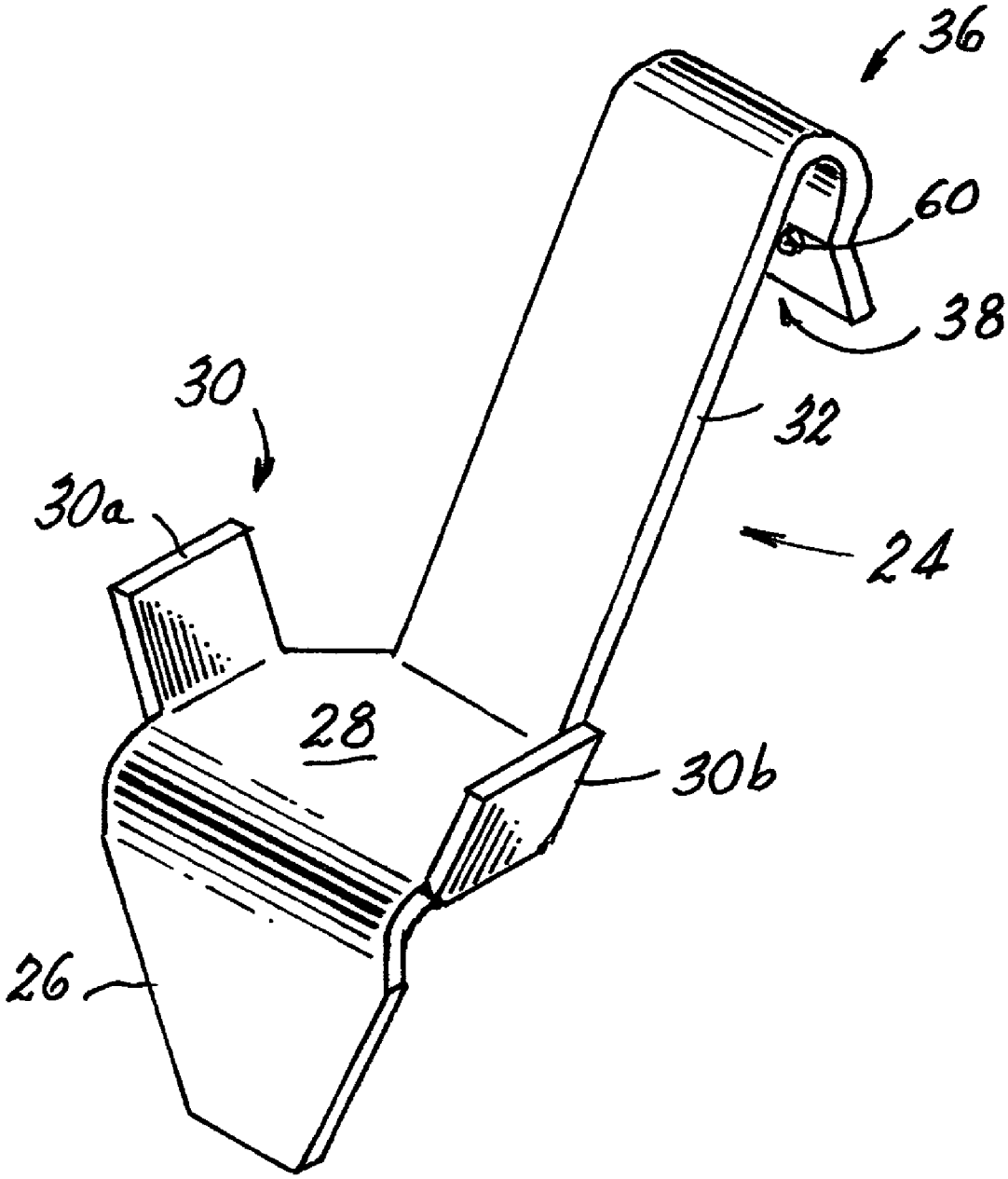
FIG. 2 is a perspective view of an embodiment of an electrical contact according to an aspect of the invention.

An electrical contact 24, one form of which is shown in FIG. 2, has a first depending leg 26, an intermediate transverse portion 28 including a seat engager 30 adapted to cooperate with the seat 22, and a projecting leg 32 extending away from the intermediate transverse portion 28 and along a side 34 of the bottom 14, the first depending leg 26 being in mechanical and electrical contact with one of the lead-ins, for example, 54. Preferably, the attachment to the lead-in is by welding. If desired, the projecting leg 32 can engage a groove formed in the side 34.

A terminus 36 of the projecting leg 32 is formed with a reentrant portion 38.

The body 12 of the lamp 50 has a lamp base 16, which has a pair of electrical contacts 40, 42 insulated from each other. In a preferred embodiment the lamp base 16 is a standard Edison base wherein the electrical contact 40 is the screw portion and contact 42 is the eyelet. The terminus 36 of the projecting leg 32 makes electrical connection with the electrical contact 40, as by welding, and the terminus 36 can be provided with a divot 60 to insure the proper location of the weld.

For the contacts 24, 24*a* and 24*c* (FIGS. 2, 3 and 5) the seat 22 can include two spaced-apart grooves for receiving the two spaced-apart wings 30*a*, 30*b*. Alternatively, the wings 30*a*, 30*b* can have a friction fit with the seat 22.

Figure 4:
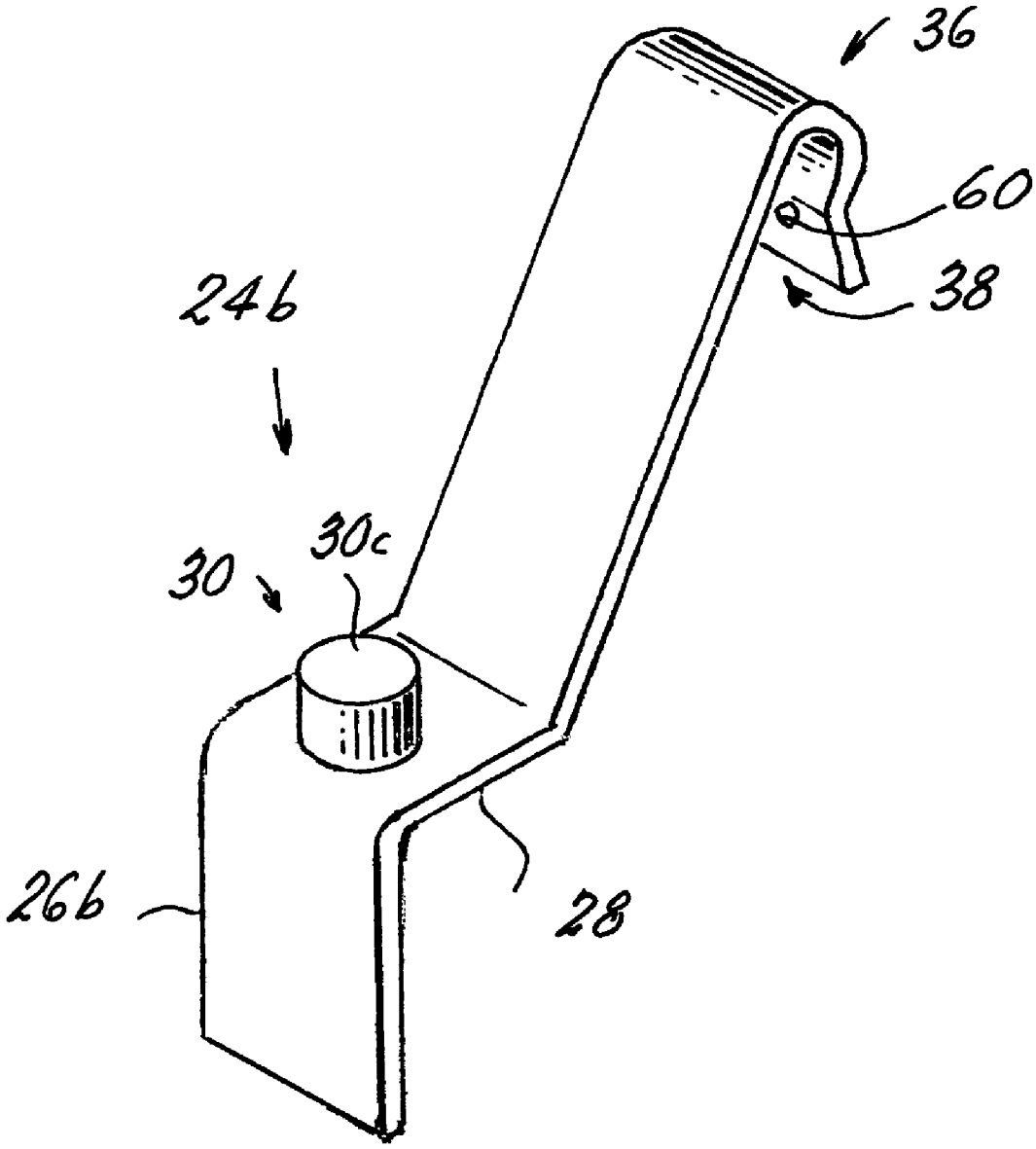
FIG. 4 is a similar view of yet another alternate embodiment.

Another alternate contact, 24*b*, which is illustrated in FIG. 4, includes a boss 30*c* that fits into a dimple 44, (see FIG. 6) which is formed in the bottom 14.

If desired the depending leg 26 of the contacts 24 can be formed with a semi-cylindrical configuration, to more closely match the configuration of the lead-in 54.

In some lamp types, for example, in a PAR 20 lamp, the bottom or heel 14 can have a rectangular projection and the intermediate transverse portion 28 can easily be formed to accommodate this feature, as shown in FIG. 3, wherein the intermediate transverse portion 28 has a stamped feature 70 to fit a rectangular projection.

As shown in FIG. 5, a contact 24*c* can be provided with a transverse portion 28*a* that is substantially wider than the transverse portion 28 of contacts 24, 24*a* and 24*b*, thus allowing the contact 24 to be used with multiple varieties of lamps.

To assemble a lamp 50 the light source 51 has its capsule base 20 inserted into the channel 18. The contact 24 (or 24*a* or 24*b*) is fitted tightly against the bottom 14 with the wings 30*a* and 30*b* engaging the seat 22 and the depending leg 26 is attached, as by welding, to the lead-in 54, and wire 72 is attached to the other lead-in 52. The lamp base 16 is then applied with the end 73 of the wire 72 fed through the eyelet 42 and the leading edge 74 of the screw portion 40 of the lamp base 16 entering the reentrant portion 38 of the terminus 36 of the projecting leg 32. With the lamp base 16 in proper position the terminus 36 is welded to the screw portion 40 and the end 73 is welded or soldered to the eyelet 42.

Subsequently the cover or lens 50*a* can be applied to complete the lamp.

Thus, the application of the contact 24 provides both the electrical connection and the necessary mechanical support for the light source 51, eliminating much of the former hand labor previously required. It is readily automated further eliminating additional hand labor and improving efficiency of assembly operations. Further, by varying the size of the transverse portion 28 the contact is readily adaptable to many lamp types.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A lamp envelope comprising a body having a base, said base comprising:

a bottom having a channel;

a seat formed with said bottom adjacent said channel, said seat comprising a dimple formed in said bottom;

an electrical contact having a first depending leg;

an intermediate transverse portion including a seat engager engaging said seat, said seat engager comprising a boss that fits into said dimple, and a projecting leg extending away from said intermediate transverse portion and along a side of said bottom.

2. The lamp envelope of claim 1 wherein a terminus of said projecting leg is formed with a reentrant portion.

3. The lamp envelope of claim 2 wherein said base has a pair of electrical contacts insulated from each other and said terminus of said projecting leg makes electrical connection with one of said electrical contacts.

4. The lamp envelope of claim 3 wherein said electrical contact that is connected to said terminus of said projecting leg is threaded.

5. A lamp comprising:

a lamp envelope having a body with a lamp base, said lamp base comprising:

a bottom having a channel;

a seat formed with said bottom adjacent said channel, said seat comprising a dimple formed in said bottom;

a light source capsule having a capsule base, said base being received in said channel and having two electrical lead-ins extending therefrom and through said channel; and an electrical contact having a first depending leg, an intermediate transverse portion including a seat engager, said seat engager comprising a boss that fits into said dimple and adapted to cooperate with said seat, and a projecting leg extending away from said intermediate transverse portion and along a side of said bottom, said first depending leg being in mechanical and electrical contact with one of said lead-ins.

6. The lamp of claim 5 wherein a terminus of said projecting leg is formed with a reentrant portion.

7. The lamp of claim 6 wherein said lamp base has a pair of electrical contacts insulated from each other and said terminus of said projecting leg makes electrical connection with one of said electrical contacts.

8. The lamp of claim 7 wherein said electrical contact that is connected to said terminus of said projecting leg is threaded.

* * * * *